United States Patent [19]

D'Urso

[11] Patent Number: 4,631,902

[45] Date of Patent: Dec. 30, 1986

[54] METHOD AND MACHINE FOR WRAPPING IN PARTICULAR FRUIT AND VEGETABLES WITH A FILM OF PLASTICS MATERIAL

[75] Inventor: Carmelo D'Urso, Le Chesnay, France

[73] Assignee: XEDA International, Le Chesnay, France

[21] Appl. No.: 710,305

[22] Filed: Mar. 8, 1985

[30] Foreign Application Priority Data

Mar. 12, 1984 [FR] France ..... 84 03765

[51] Int. Cl.[4] ..... B65B 11/08

[52] U.S. Cl. ..... 53/461; 53/140; 53/221; 118/506; 427/4

[58] Field of Search ..... 53/140, 453, 454, 456, 53/452, 141, 461, 466, 559, 560, 202, 221; 193/7, 2 R, 2 D; 118/506, DIG. 6, 13, 401; 427/4, 445; 426/307, 308, 90

[56] References Cited

U.S. PATENT DOCUMENTS

| | | | |
|---|---|---|---|
| 2,333,887 | 11/1943 | Redlinger | 427/4 X |
| 2,560,487 | 7/1951 | Shugart et al. | 118/DIG. 6 X |
| 2,622,380 | 12/1952 | Snyder | 53/464 |
| 2,703,760 | 3/1955 | Cunning | 426/308 |
| 3,299,195 | 1/1967 | Chenoweth et al. | 53/140 X |
| 3,404,025 | 10/1968 | Wootten | 118/506 X |
| 3,465,495 | 9/1969 | Zwiacher et al. | 193/7 X |
| 3,468,099 | 9/1969 | Vogt | 53/140 |

FOREIGN PATENT DOCUMENTS

| | | | |
|---|---|---|---|
| 156118 | 4/1954 | Australia | 53/140 |
| 219906 | 1/1959 | Australia | 53/140 |

*Primary Examiner*—Horace M. Culver

*Attorney, Agent, or Firm*—Wenderoth, Lind & Ponack

[57] ABSTRACT

A film of liquid plastic material is formed by surface tension on supports. By a relative displacement, a product and the film are brought into contact with each other, the film deforming under action of the product so as to be progressively applied on and closing onto the product and completely wrapping the product after the product has passed through the supports.

15 Claims, 7 Drawing Figures

FIG. 1
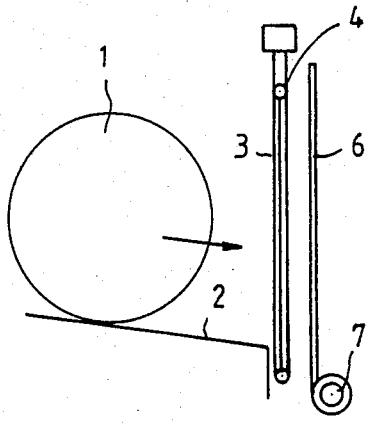
FIG. 2
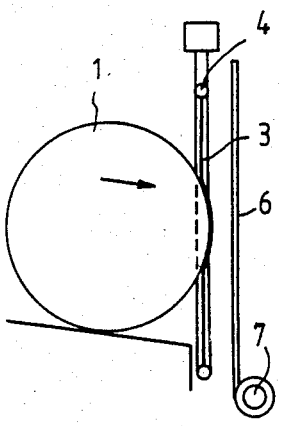
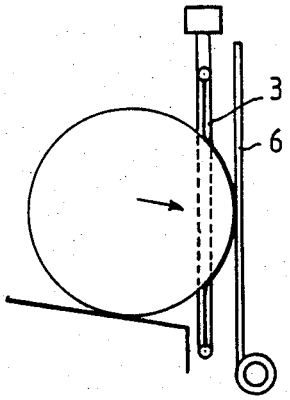
FIG. 3
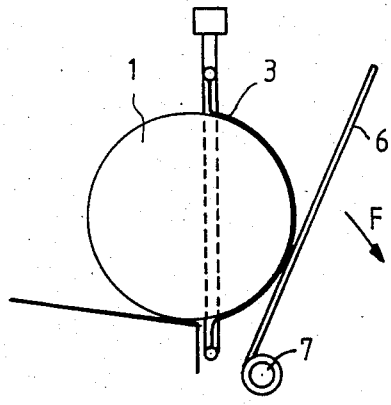
FIG. 4
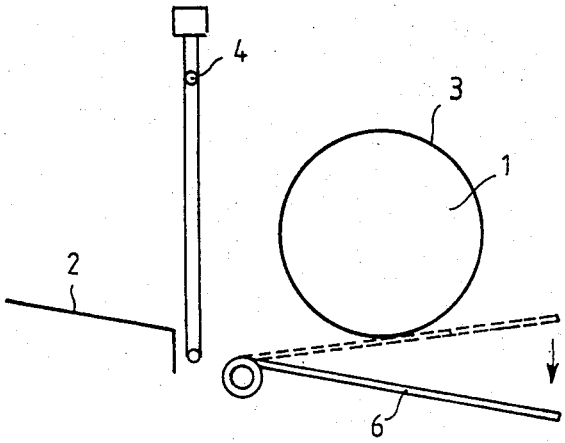
FIG. 5

METHOD AND MACHINE FOR WRAPPING IN PARTICULAR FRUIT AND VEGETABLES WITH A FILM OF PLASTICS MATERIAL

FIELD OF THE INVENTION

The present invention relates to a process for wrapping products, in particular fruit and vegetables, with a film of plastics material, and to a machine for carrying out said method.

BACKGROUND OF THE INVENTION

Methods are already known for wrapping fruit and vegetables in a film of plastics material and in particular of polyethylene.

These methods always employ preformed films of plastics material which are subsequently used to wrap the products which are desired to be conditioned. The wrapping of the products with such methods is therefore carried out in two stages and this requires expensive investments and a relatively long overall conditioning time.

BRIEF SUMMARY OF THE INVENTION

An object of the invention is to simplify the conditioning of products, and in particular fruit and vegetables, by wrapping them in a single operation.

The invention thus has for purpose to avoid inevitable stoppages in supplies which occur when the manufacture of the plastic wrappings and the wrapping of the products with these wrappings are carried out separately Another purpose of the invention is to reduce the cost of the conditioning of the products and to improve the sanitary conditions concerning the handling of the products, such as fruit and vegetables for example, and to increase their preservation time while maintaining their freshness practically intact.

The invention therefore provides a method for wrapping products, and in particular fruit and vegetables, with a film of plastics material, said method comprising forming by surface tension on support means a film of liquid plastics material, bringing the product to be wrapped into contact with the film by a relative displacement of the product and the film, causing the deformation of the film while it is still in the liquid state under the action of the product and progressively applying the film on the product, the film closing onto the product after the passage of the product through said support means and perfectly conforming to the shape of the product so as to wrap it completely.

According to a particlar feature of the invention, the film of liquid plastics material is formed by plunging the support means into a bath of liquified plastics material, and then withdrawing said support means from the bath.

Another object of the invention is to provide a machine for carrying out the method defined hereinbefore, said machine comprising means for feeding products to be wrapped, means for forming a wrapping film of plastics material on at least a support, means for putting products in contact with the film of plastics material, and means for producing a relative displacement between the product and the support of the film so as to apply the film on said product.

BRIEF DESCRIPTION OF THE DRAWINGS

The invention will be described hereinafter in more detail with reference to the drawings which illustrate one manner of carrying out the invention, which is given solely by way of example, and in which:

FIGS. 1 to 5 are diagrammatic views of different stages of the wrapping of a fruit by the method of the invention;

DETAILED DESCRIPTION OF THE INVENTION

Figure 6:
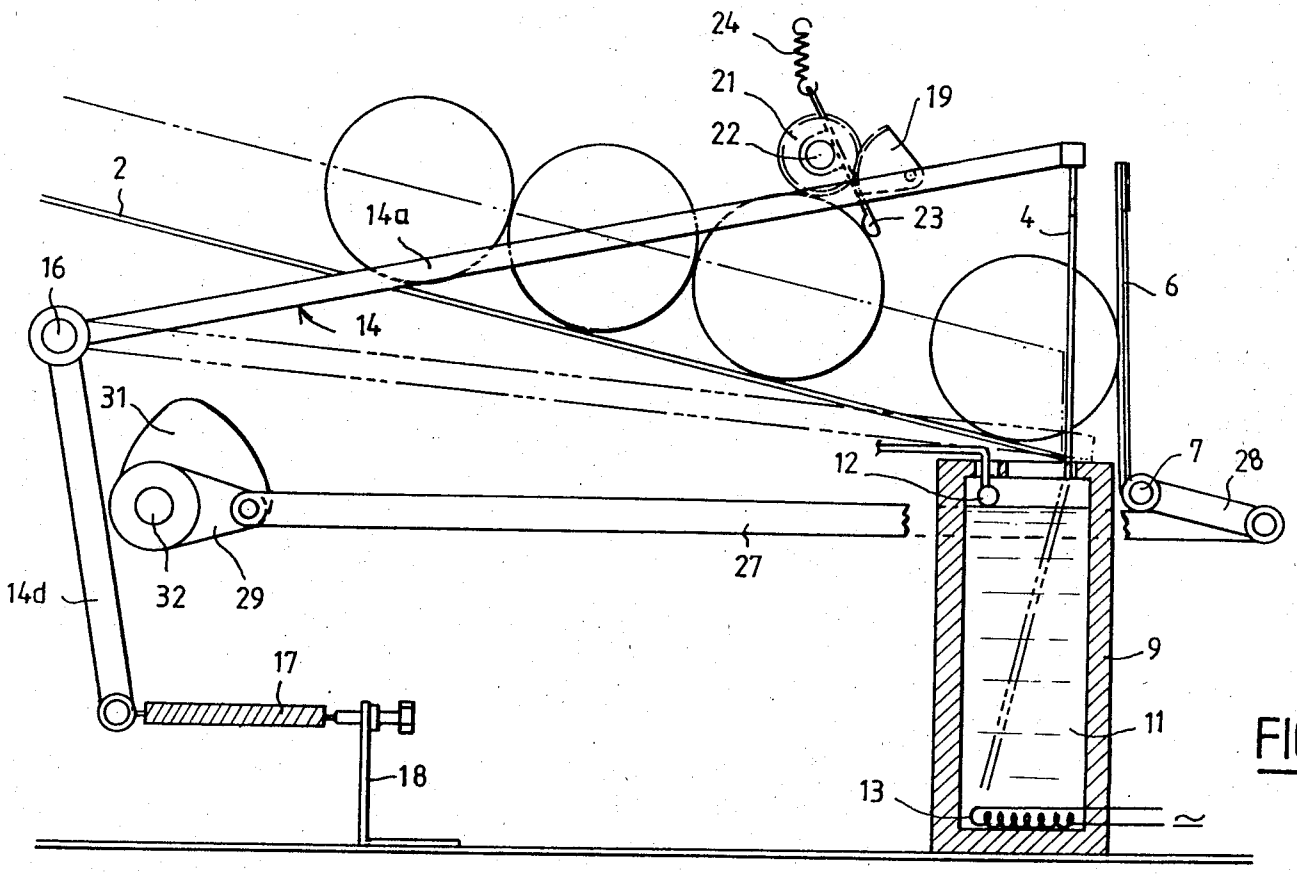
FIG. 6 is an elevational view of a machine for carrying out the method of the invention.

As can be seen in FIG. 1, a fruit 1 to be wrapped rolls along an inclined plane 2 toward a film 3 of liquid plastics material formed by surface tension on a ring-shaped support 4.

When the fruit 1 comes into contact with the film 3 (FIG. 2), it starts to deform the film and the latter starts to adhere to the surface of the fruit.

After having travelled through a further short distance, the fruit 1 comes into contact with a retractable flap 6 which is adapted to accompany the rest of the displacement of the fruit in the course of the wrapping procedure.

The flap 6 is advantageously covered with an anti-adhesive material, such as Teflon so that the film of plastics 3 does not adhere to the flap 6. The latter is actuated to rotate in the direction of arrow F (FIG. 4) so that the fruit still further deforms the film 3. The pivoting flap 6 is finally completely retracted in front of the fruit 1 which can then continue its travel, while the film of plastics material 3 closes around the fruit by the effect of surface tension and perfectly conforms to its shape.

The fruit 1 is then completely wrapped by the film 3 (FIG. 5).

Figure 7:
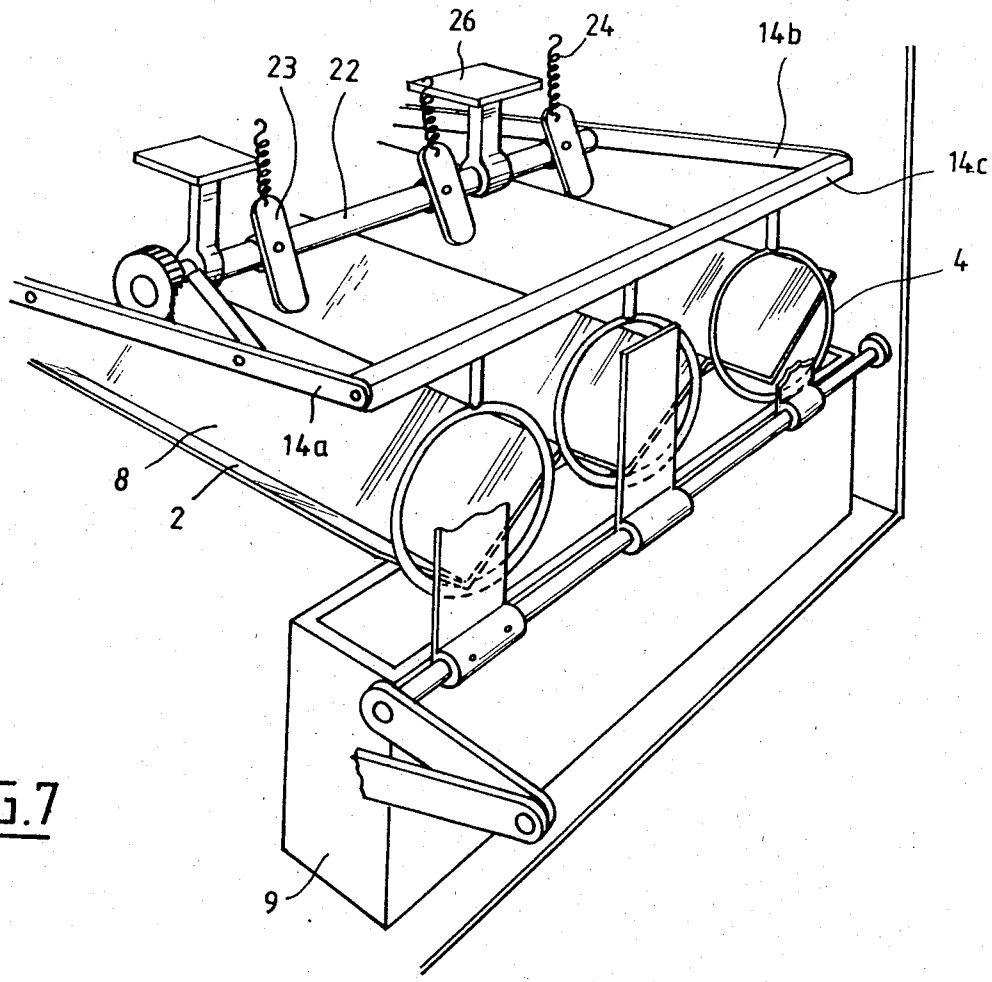
FIG. 7 is a perspective view of a part of the machine shown in FIG. 6.

A machine adapted to carry out the method described hereinbefore is shown in FIGS. 6 and 7. It comprises a conveyor belt (not shown) which feeds the fruit and vetatables to an inclined surface divided into three channels which have a V-shaped cross-section.

Placed above the channels at the outlet end of the latter is a tank 9 of refractory material containing a bath 11 of molten plastics material, for example a copolymer of polyethylene and acrylic acid, whose softening temperature is on the order of 100° C. and whose temperature of use is of 150° to 200° C.

The tank is provided with an electromagnetic level detector 12 which controls a filling system for maintaining the level of the liquid 11 in the tank 9 constant. The tank also includes at its bottom an electric heating resistor 13 for heating the bath 11. A thermostat (not shown) acts on the electric current so as to maintain the temperature of the bath 11 constant. A movable frame 14 pivotally mounted on a fixed shaft 16 has two lateral arms **14*a*, 14*b* whose ends remote from the shaft 16 are interconnected by a cross-member 14*c*. The cross-member 14*c* carries a series of rings 4 adapted to be plunged into the tank 9. The frame 14 includes an actuating arm 14*d* connected to the end thereof mounted on the pivot shaft 16**.

This arm **14*d* is biased by a return spring 17 secured to a support 18 which is fixed to the frame of the machine. The lateral arm 14*a* carries, in the vicinity of the cross-member 14c of the frame, a toothed sector 19 which is fixed to said arm 14a**.

This toothed sector 19 is engaged with a free gear wheel 21 carried by a shaft 22 on which are fixed as many plates or stop surfaces 23 as there are channels 8. These stop surfaces 23 are each biased by a return spring 24 toward a position which is roughly perpendicular to the movable frame 14.

The shaft 22 is supported by bearings 26 fixed to a frame (not shown). Flaps 6 covered with Teflon are pivotally mounted on a fixed shaft 7 which is connected to a link 27 through a crank 28. The link 27 is connected at its end remote from the crank 28 to a second crank 29 which is connected to rotate with a cam 31 fixed to a rotative shaft 32 which is, for example, driven by an electric motor (not shown). The cam 31 is in contact with the arm 14d which is biased by the return spring 18.

The wrapping machine just described may be associated at its output end with a machine for depositing on the wrapped products a layer of wax emulsion which forms a film having a lower permeability to gases than that of the plastics material employed for forming the wrapping film.

The machine just described operates in the following manner:

With the movable frame 14 initially in the upper position, the items of fruit 1 are fed in the various channels 8 of the inclined plane 2. In the first channel 8, for example, the first fruit 1 is stopped by the stop surface 23. The cam 31 then exerts a thrust on the arm 14d in opposition to the action of the return spring 17 and causes the frame 14 to pivot in the clockwise direction about the shaft 16 so that the rings 4 are made to plunge into the bath 11 of molten plastics material. The cam 31 continues its movement and the lateral arm 14d, under the action of the spring 17, raises the rings 4 to a nearly vertical position. When the rings 4 are withdrawn from the bath 11, a film of liquid plastics material is formed by surface tension within each ring 4. When the movable frame 14 rises, the toothed sector 19 meshes with the free-wheel 21 which then rotates in the counterclockwise direction and drives along therewith, in opposition to the action of the spring 24, the stop surface 23 to a roughly horizontal position. In being thus retracted, the stop surface 23 allows the first fruit to pass. As soon as the movable frame 14 has reached its upper position, the spring 24 biases the stop surface 23 toward its substantially vertical position of rest, owing to the action of the free-wheel 21, and thus blocks the second fruit. The first fruit then continues its travel along the inclined plane 2, comes into contact with the film 3, is wrapped by the latter, and then abuts against the pivotal flap 6 which is at this moment parallel to the ring. As the cam 31 continues its movement, it actuates the flap 6 through the linkage 29, 27, 28. The flap 6 then pivots and allows the first fruit wrapped in the film 3 to pass. With the copolymer of polyethylene, there is obtained a film having a thickness on the order of $5\times10^{-3}$ to $2\times10^{-2}$ mm. The cam 31 again acts on the arm 14d so that the rings 4 are again plunged into the bath 11 while the linkage 29,27,28 raises the pivotal flap 6 to its vertical position. The cycle then repeats in respect of all the channels.

Owing to the method of the invention, the products receive a kind of second protective skin which can be removed before consumption of the product. In this way there are avoided risks of rotting in the case of fruit and vegetables, and risks of contamination by handling and by mutual contact. Further, the loss of water is highly reduced and the freshness of the products is maintained practically intact so that it is possible to preserve the fruit before consumption for a much longer period of time without however preventing the breathing of the product.

Further, in distinction to wrapping by a spraying method, the film deposited by the method according to the invention can be fully removed by "pealing".

The polyethylene employed is very permeable to gases and slightly impermeable to water, and, if the film of plastics material is covered, by means of a conventional method, with a coating of wax impermeable to gases, a double sealing effect is achieved. In the case of fruit, in respect of which a delayed ripening is required, this association is of great interest.

The two layers may be withdrawn at the same time.

It must be understood that the scope of the invention is not intended to be limited to the manner of carrying out the invention just described and modifications may be made in the invention.

For example, the means for stopping the products may be controlled by a photo-electric cell.

The movable frame 14 may be dispensed with and replaced by an automatic device for plunging the rings 4 into the bath 11. The rings 4 may moreover be replaced by U-shaped frames.

Another advantage of the method according to the invention resides in the fact that a fungicide and/or anti-oxidizing preservation product may be mixed with the plastics material by addition in the bath, it being possible to remove also this product completely when the wrapping film is removed, except for traces which have migrated to the skin of the product. In the example just described, the plastics material of the bath is a polyethylene copolymer.

As preserving products, there may be mentioned for example thiabendazole as a fungicide and ethoxyquine as an anti-oxidizing agent.

There may also be used as a wrapping product pure polyethylene and other copolymers based on polyethylene and other plastics materials having a similar permeability property.

As concerns the preserving products to be incorporated in the protective film deposited in accordance with the method of the invention, it is advantageous to disperse these products in the molten mass from which are prepared the granules which will constitute the bath of liquid wrapping material.

These products may also be added in the bath just before application on the products to be wrapped.

The invention just described is considered to be applied to the wrapping of fruit and vegetables.

However, it will be understood that it may be employed for depositing a protective film on other non-food products, such as mechanical parts.

I claim:

1. A method for wrapping a discrete product, in particular a product selected from fruit and vegetables, in a film of plastics material, said method comprising:

forming a liquid film of wrapping plastics material on support means by plunging said support means into a bath of molten plastics material and then withdrawing said support means from said bath;

feeding said product on an inclined surface and thereby bringing said product by gravity into contact with said film while said film still is in the liquid state, and thus deforming said film under the action of said product by passing said product through said support means until said product comes into contact with a pivotable flap beyond said support means; and then progressively retracting said pivotable flap and causing said product to continue its travel through said support means and further deforming said film, such that said film closes around said product after the passage thereof completely through said support means so as to completely wrap said product.

2. A method for wrapping a product selected from fruit and vegetables, in a film of plastics material, said method comprising:

forming a liquid film of plastics material on support means by plunging said support means into a bath of molten plastics material and then withdrawing said support means from said bath;

rolling said product on a surface and thereby bringing said product by gravity into contact with said film while said film still is in the liquid state and thus deforming said film under the action of said product by passing said product through said support means until said product comes into contact with a pivotable flap beyond said support means; and then progressively retracting said pivotable flap and causing said product to continue its travel through said support means and further deforming said film, such that said film closes around said product after the passage thereof completely through said support means so as to completely wrap said product.

3. A method according to claim 2, wherein said bath of plastics material is a bath of molten polyethylene.

4. A method according to claim 2, wherein said bath of plastics material is a bath of molten polyethylene copolymer.

5. A method according to claim 4, wherein said film is formed to a thickness of $5.10^{-3}$ to $2.10^{-2}$ mm.

6. A method according to claim 2, wherein said flap is covered by an anti-adhesive material.

7. A method according to claim 2, further comprising, after wrapping said product with said film of plastics material, depositing on said film a coating of a wax emulsion forming a film which has a lower permeability to gases than that of the plastics material employed.

8. A machine for wrapping discrete products, in particular products selected from fruit and vegetables, in a film of plastics material, said machine comprising:

at least one support;

means for forming a liquid film of wrapping plastics material on said support and comprising a tank containing a bath of molten plastics material and means for plunging said support into said bath and for then withdrawing from said bath said support having formed thereon said film;

means for placing a product in contact with said liquid film on said support, said means comprising an inclined surface on which the products are displaced sequentially by gravity in a direction to pass through said support;

pivotable flap means, disposed beyond said support relative to said direction of displacement of the products, for contacting the product; and means for progressively actuating the pivotable flap and thereby causing the product to continue its travel through said support and further deform said film, such that said film closes around the product after the passage thereof completely through said support so as to completely wrap the product.

9. A machine according to claim 8, wherein said flap is covered by an anti-adhesive material.

10. A machine according to claim 8, wherein said placing means comprise means defining an inclined surface including at least one V-section channel for conveying the product to said support of said film of plastics material.

11. A machine according to claim 10, comprising a plurality of said channels, and wherein said plunging means comprises a frame pivotable about a fixed shaft, said frame carrying a plurality of said supports equal to said plurality of channels, each said support being associated with a respective said channel, thereby conveying a plurality of products to said supports.

12. A machine according to claim 11, wherein said supports comprise rings carried by a cross-member of said pivotable frame.

13. A machine according to claim 11, wherein said supports comprise U-shaped mounts carried by a cross-member of said pivotable frame.

14. A machine according to claim 11, further comprising means for actuating said plunging means and comprising a cam for actuating said pivotable frame to move against the action of a return spring, said means for actuating said pivotable flap being driven by said cam.

15. A machine according to claim 8, further comprising means for stopping the products before they are wrapped, and comprising a least a means defining a stop surface, a resiliently yieldable return means for biasing said stop surface to an operative position for stopping the products, said stop surface being fixed to a shaft, and a mechanism comprising a toothed sector and a free wheel connected to said stop surface for shifting said stop surface in opposition to the action of said resiliently yieldable return means to an inoperative retracted position allowing passage of the products.

* * * * *